US009196182B2

(12) United States Patent
Baek et al.

(10) Patent No.: US 9,196,182 B2
(45) Date of Patent: Nov. 24, 2015

(54) DISPLAY DEVICE

(71) Applicant: Samsung Display Co., Ltd., Yongin (KR)

(72) Inventors: Kwang Hyun Baek, Asan-si (KR); Bum Lee, Cheonan-si (KR); Sang-Kil Lee, Seongnam-si (KR); So-Yeon Yi, Seoul (KR); Kyu-Hun Lim, Asan-si (KR); Jae Jin Choi, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 422 days.

(21) Appl. No.: 13/692,360

(22) Filed: Dec. 3, 2012

(65) Prior Publication Data

US 2014/0063023 A1 Mar. 6, 2014

(30) Foreign Application Priority Data

Aug. 29, 2012 (KR) ..... 10-2012-0094798

(51) Int. Cl.

| | |
|---|---|
| ***G09G 3/36*** | (2006.01) |
| ***G09G 1/00*** | (2006.01) |
| ***G09G 3/20*** | (2006.01) |
| *G09G 3/32* | (2006.01) |

(52) U.S. Cl.

CPC .. *G09G 1/00* (2013.01); *G09G 3/20* (2013.01); *G09G 3/3275* (2013.01); *G09G 3/3688* (2013.01); *G09G 2300/0426* (2013.01); *G09G 2310/0275* (2013.01); *G09G 2370/08* (2013.01)

(58) Field of Classification Search

CPC ..... G09G 3/3688; G09G 3/3648; G09G 2310/027

See application file for complete search history.

(56) References Cited

U.S. PATENT DOCUMENTS

| | | | | |
|---|---|---|---|---|
| 7,102,601 | B2 | 9/2006 | Devos et al. | |
| 7,151,522 | B2 | 12/2006 | Tamura | |
| 7,663,591 | B2 | 2/2010 | Sasaki et al. | |
| 7,782,312 | B2 | 8/2010 | Cho et al. | |
| 7,956,836 | B2 | 6/2011 | Yamazaki | |
| 2002/0130974 | A1* | 9/2002 | Kimura et al. | 348/615 |
| 2005/0128169 | A1* | 6/2005 | Kang et al. | 345/87 |
| 2005/0140628 | A1 | 6/2005 | Oh et al. | |
| 2006/0139291 | A1* | 6/2006 | Cho et al. | 345/100 |

FOREIGN PATENT DOCUMENTS

| | | |
|---|---|---|
| KR | 10-2007-0049922 | 5/2007 |
| KR | 10-2008-0043515 | 5/2008 |
| KR | 10-2011-0076642 | 7/2011 |

* cited by examiner

*Primary Examiner* — Kevin Nguyen

(74) *Attorney, Agent, or Firm* — H.C. Park & Associates, PLC

(57) ABSTRACT

A display device having a display panel including a plurality of data lines; a data driver including at least one data driving circuit chip which transmits data signals to the plurality of data lines; and a signal controller transmitting a dummy control signal and an output image signal to a first data driving circuit chip of at least one data driving circuit chip. The first data driving circuit chip may include zero or more dummy channels which are not connected with the data lines, and the dummy control signal includes information on positions of the dummy channels included in the first data driving circuit chip and information regarding the number of dummy channels.

22 Claims, 10 Drawing Sheets

FIG.3

| Bit[0:1] Value | Position of dummy channel |
|---|---|
| 00 | Center |
| 01 | Right side |
| 10 | Left side |
| 11 | Both sides |

DISPLAY DEVICE

CROSS-REFERENCE TO RELATED APPLICATION

This application claims priority to and the benefit of Korean Patent Application No. 10-2012-0094798, filed on Aug. 29, 2012, which is hereby incorporated by reference for all purposes as if fully set forth herein.

BACKGROUND

1. Field

Exemplary embodiments of the present invention relate to a display device.

2. Discussion of the Background

Display devices which are widely used currently include a liquid crystal display, an organic light emitting diode display, an electrophoretic display, and the like.

A display device includes a plurality of pixels and a plurality of display signal lines. Each pixel includes a switching element and a pixel electrode connected thereto, and the switching element is connected with the display signal line. The display signal lines include gate lines transmitting gate signals and data lines transmitting data signals. The pixel electrode receives the data signal through the switching element, such as a thin film transistor, according to a gate signal. The gate signal is generated in a gate driver according to a control of a signal controller to be outputted to a plurality of gate lines, and the data signal may be acquired when a data driver receives a digital image signal from the signal controller to convert the digital image signal into a data voltage.

The pixel electrode, the switching element, and the like may be formed on a display panel. The signal controller is generally positioned outside the display panel and may be provided on a printed circuit board (PCB) connected with the display panel. Further, the data driver may be directly installed on the display panel in at least one IC chip form (chip on glass, COG, etc.), or may be installed on a flexible printed circuit film (FPC) to be attached to the display panel in a tape carrier package (TCP) form (chip on FPC, COF). In the case of the COF, the flexible printed circuit film (FPC) may be positioned between the printed circuit board (PCB) and the display panel.

At least one data driving circuit chip included in the data driver includes a plurality of channels capable of outputting the data signal. In the case where the number of data lines formed on the display panel and the number of channels included in all of the data driving circuit chips are not the same as each other, dummy channels that do not substantially output the data signals among the channels of the data driving circuit chips may be included.

Recently, a demand for a display device having a small peripheral area which is positioned around a display area displaying an image of the display panel has increased. When each of the data driving circuit chips used in one display device have the same number of dummy channels, there is a limit to a layout of the data driving circuit chips, and as a result, the peripheral area of the display panel may be increased.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide a display device having an increased degree of freedom of a layout of data driving circuit chips to minimize a size of a peripheral area of the display panel.

Exemplary embodiments of the present invention also provide a display device having an increased degree of freedom of a design, such as a size of the display panel.

Exemplary embodiments of the present invention also provide a display device which minimizes the kinds of data driving circuit chips which are used in the display device.

Additional features of the invention will be set forth in the description which follows, and in part will be apparent from the description, or may be learned by practice of the invention.

An exemplary embodiment of the present invention discloses a display device, including: a display panel including a plurality of data lines; a data driver including at least one data driving circuit chip which transmits data signals to the plurality of data lines; and a signal controller transmitting a dummy control signal and an output image signal to a data driving circuit chip. The dummy control signal includes information regarding a number of dummy channels that are not connected with the data lines and included in the data driving circuit chip, and also information regarding a position of the dummy channels when the data driving circuit chip includes one or more dummy channels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

FIG. 3 is a table illustrating information regarding a position of a dummy channel of a data driving circuit chip in the display device according to the exemplary embodiment of the present invention.

DETAILED DESCRIPTION OF THE ILLUSTRATED EMBODIMENTS

Figure 1:
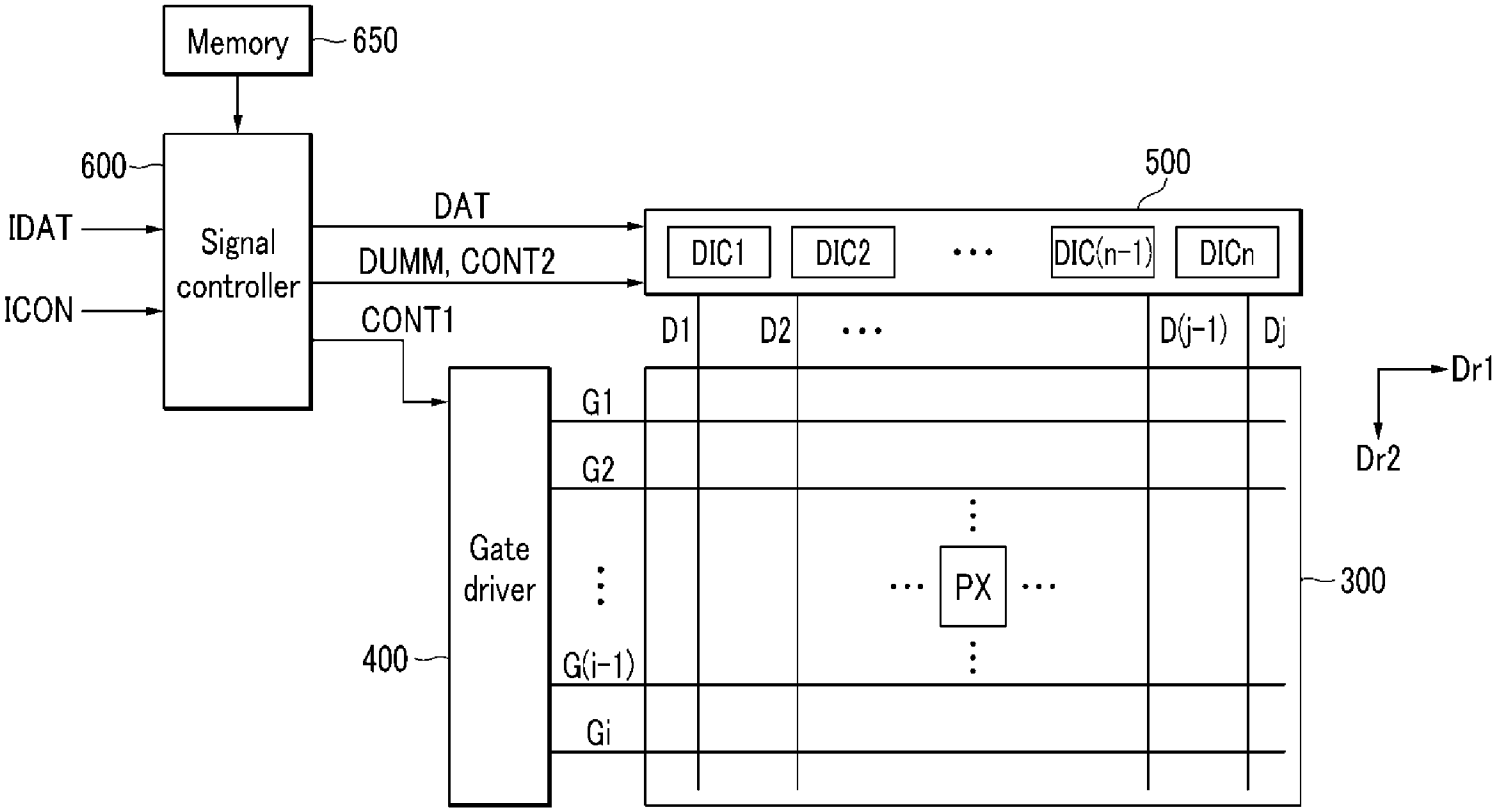
FIG. 1 is a block diagram of a display device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

First, a display device according to an exemplary embodiment of the present invention will be described with reference to FIGS. 1 and 2.

Figure 2:
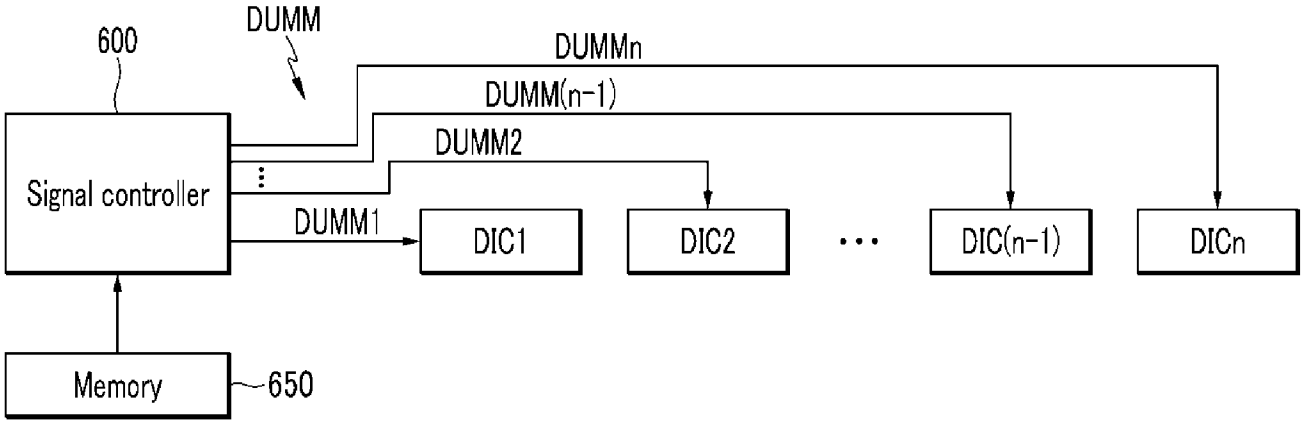
FIG. 2 is a block diagram of a part of the display device according to the exemplary embodiment of the present invention.

FIG. 1 is a block diagram of a display device according to an exemplary embodiment of the present invention, and FIG. 2 is a block diagram of a part of the display device according to an exemplary embodiment of the present invention.

Referring to FIG. 1, the display device according to an exemplary embodiment of the present invention includes a display panel 300, a gate driver 400, and a data driver 500 which are connected to the display panel 300; a signal controller controlling the gate driver 400 and the data driver 500; and a memory 650 connected with the signal controller 600.

The display panel 300 includes a plurality of signal lines and a plurality of pixels PX which are connected thereto and arranged in a substantially matrix form, when viewed as an equivalent circuit. In the case where the display device is a liquid crystal display, the display panel 300 may include lower and upper display panels (not illustrated) which face each other, and a liquid crystal layer (not illustrated) interposed between the two display panels.

The signal lines include a plurality of gate lines G1-Gi (i is a natural number) for transmitting gate signals (referred to as "scanning signals") and a plurality of data lines D1-Dj (j is a natural number) for transmitting data signals. The plurality of data lines D1-Dj may be sequentially arranged in a first direction Dr1, which is a row direction, and each of the data lines D1-Dj may extend in a second direction Dr2, which is a column direction.

One pixel PX may include at least one switching element connected to at least one of the data lines D1-Dj and at least one of the gate lines G1-Gi and at least one pixel electrode connected thereto. The switching element may include at least one thin film transistor and may be controlled according to gate signals transmitted by the gate lines G1-Gi to transmit data signals transmitted by the data lines D1-Dj to the pixel electrode.

The gate driver 400 is connected to the gate lines G1-Gi to apply, to the gate lines G1-Gi, the gate signal configured in combination of a gate-on voltage Von and a gate-off voltage Voff.

The data driver 500 is connected with the data lines D1-Dj and selects a gray scale voltage from a gray scale voltage generator (not illustrated) and applies the selected gray scale voltage as a data signal to the data lines D1-Dj. However, in the case where the gray scale voltage generator does not supply all of the gray scale voltages, but supplies only a predetermined number of reference gray scale voltages, the data driver 500 divides the reference gray scale voltages to generate gray scale voltages for the entire gray scale and select a data signal among the gray scale voltages.

Referring to FIGS. 1 and 2, the data driver 500 according to an exemplary embodiment of the present invention includes at least one of data driving circuit chips DIC1, DIC2, . . . , DICn (n is a natural number). Each of the data driving circuit chips DIC1-DICn includes a plurality of channels capable of outputting data signals. The number of channels may be the same in all of the data driving circuit chips DIC1-DICn or it may differ with respect to at least two data driving circuit chips DIC1-DICn. The interval between the channels included in each of the data driving circuit chips DIC1-DICn may be substantially the same.

The channel of each of the data driving circuit chips DIC1-DICn includes at least one output channel (referred to as an output pin) which is connected to the data lines D1-Dj to substantially output a data signal and dummy channels, if any.

The dummy channels, as channels which are not connected with the data lines D1-Dj of the display panel 300, do not substantially output a data signal. The number of dummy channels included in each of the data driving circuit chips DIC1-DICn and the position of the dummy channels of the data driving circuit chips DIC1-DICn may be freely set by the signal controller 600.

The data driving circuit chips DIC1-DICn may be installed on the display panel 300 to be connected with the data lines D1-Dj.

According to another exemplary embodiment of the present invention, the data driving circuit chips DIC1-DICn may be installed on a tape carrier package (TCP), such as a flexible printed circuit film (FPC film), or on printed circuit board (PCB), to be connected with the display panel 300.

The data driving circuit chips DIC1-DICn may be arranged in the first direction Dr1.

The signal controller 600 controls operations of the gate driver 400, the data driver 500, and the like. The signal controller 600 may be installed on the printed circuit board (PCB). The printed circuit board (PCB) may be electrically connected with the display panel 300 through the flexible printed circuit film and the like, and may transmit various driving signals and image data to the gate driver 400 and the data driver 500.

The memory 650 is connected with the signal controller 600 to store dummy data and then transmit the dummy data to the signal controller 600. The dummy data includes information regarding the number of dummy channels included in each of the data driving circuit chips DIC1-DICn and the position of the dummy channels of the data driving circuit chips DIC1-DICn including the dummy channels.

A display operation of the display device will now be described with reference to FIGS. 1 and 2 described above.

The signal controller 600 receives an input image signal IDAT and an input control signal ICON controlling a display thereof externally. The input image signal IDAT stores luminance information of each pixel PX, and the luminance has a number of gray scale values. An example of the input control signal ICON includes a vertical synchronization signal and a horizontal synchronizing signal, a main clock signal, a data enable signal, and the like.

The signal controller 600 processes the input image signal IDAT based on the input image signal IDAT and the input control signal ICON for one frame to convert the processed input image signal IDAT into an output image signal DAT and generate a gate control signal CONT1 and a data control signal CONT2. The signal controller 600 transmits the gate control signal CONT1 to the gate driver 400, and transmits the data control signal CONT2 and the output image signal DAT to the data driver 500.

The signal controller 600 generates a dummy control signal DUMM based on the dummy data stored in the memory 650 to transmit the generated dummy control signal DUMM to the data driver 500. The dummy control signal DUMM includes information on the number of dummy channels included in the data driving circuit chips DIC1-DICn of the data driver 500 and information on the position of the dummy channels.

The signal controller 600 rearranges the output image signal DAT based on the dummy control signal DUMM to transmit the rearranged output image signal DAT to the data driver 500.

Referring to FIG. 2, the dummy control signal DUMM may include a plurality of dummy control signals DUMM1, DUMM2, . . . , DUMMn transmitted to each of the data driving circuit chips DIC1-DICn. In detail, a first data driving circuit chip DIC1 of the data driver 500 receives a first dummy control signal DUMM1, a second data driving circuit chip DIC2 receives a second dummy control signal DUMM2, and similarly, an n data driving circuit chip DICn may receive an n dummy control signal DUMMn. Each of the data driving circuit chips DIC1-DICn may receive each of the dummy control signals DUMM1-DUMMn together with each output image signal DAT.

Referring back to FIG. 1, the data driver 500 receives the output image signal DAT for pixels PX in one row according to the data control signal CONT2 and the dummy control signal DUMM from the signal controller 600, and selects a gray scale voltage corresponding to each output image signal DAT to convert the output image signal DAT into an analog data voltage and then apply the output image signal DAT to the corresponding data line D1-Dj.

The gate driver 400 applies a gate-on voltage Von to the gate lines G1-Gi according to the gate control signal CONT1 from the signal controller 600 to turn on a switching element connected to the gate lines G1-Gi. Then, the data voltage applied to the data lines D1-Dj is applied to the corresponding pixel PX through the turned-on switching element. When the data voltage is applied to the pixel PX, the pixel PX may display luminance corresponding to the data voltage through various optical conversion elements. For example, in the case of a liquid crystal display, luminance corresponding to a gray scale of the input image signal IDAT may be displayed by controlling an inclined degree of liquid crystal molecules of the liquid crystal layer and controlling polarization of light.

While the process is repeated by setting one horizontal period [written as "1H" and being the same as one period of a horizontal synchronizing signal Hsync and a data enable signal DE] as a unit, gate-on voltages Von are sequentially applied to all of the gate lines G1-Gi and data voltages are applied to all of the pixels PX, thereby displaying images of one frame.

Then, a setting method of a position of dummy channels of the data driving circuit chips in the display device according to the exemplary embodiment of the present invention will be described with reference to FIGS. 3 to 7, together with the exemplary embodiment described above.

FIG. 3 is a table illustrating information on a position of a dummy channel of a data driving circuit chip in the display device according to an exemplary embodiment of the present invention, and FIGS. 4, 5, 6, and 7 are diagrams illustrating positions of dummy channels of a data driving circuit chip in the display device according to an exemplary embodiment of the present invention by the table illustrated in FIG. 3, respectively.

The dummy data stored in the memory 650 or the dummy control signals DUMM1-DUMMn transmitted to the respective data driving circuit chips DIC1-DICn include information on positions of dummy channels of the respective data driving circuit chips DIC1-DICn. The information on positions of dummy channels may have various bits according to a type of disposition of the dummy channels.

FIG. 3 illustrates an example in which there are two bits of information regarding the positions of the dummy channels. For example, when a bit value is "00", a position of the dummy channel is set to the center of the data driving circuit chips DIC1-DICn; when a bit value is "01", a position of the dummy channel is set to a first side (for example, a right side) of the data driving circuit chips DIC1-DICn; when a bit value is "10", a position of the dummy channel is set to a second side (for example, a left side) which is opposite to the first side of the data driving circuit chips DIC1-DICn; and when a bit value is "11", a position of the dummy channel is set to the first side and the second side, which are both sides of the data driving circuit chips DIC1-DICn.

Figure 4:
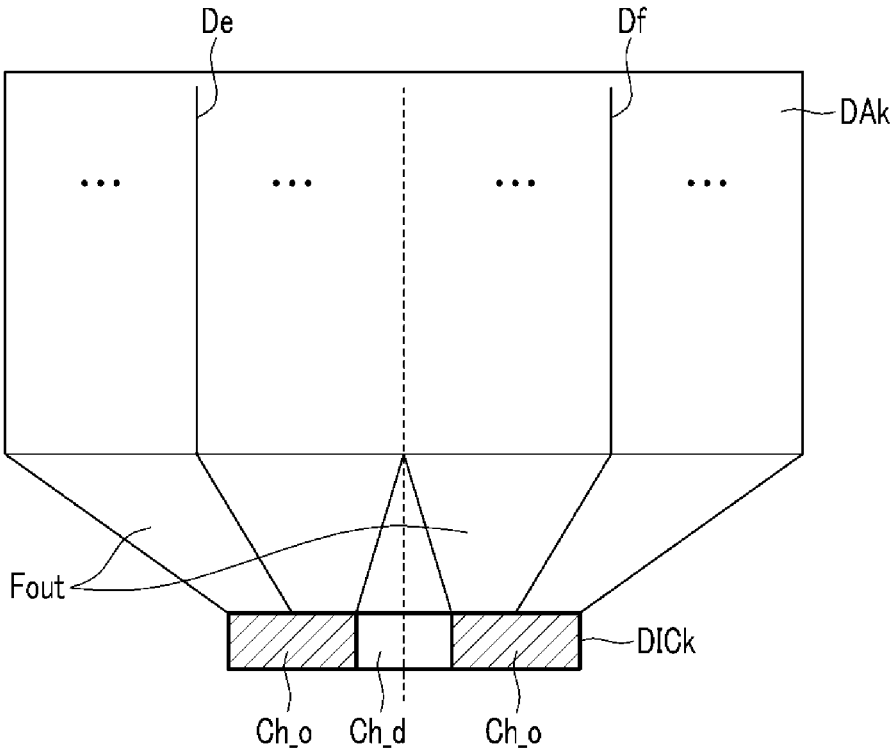
FIG. 4, FIG. 5, FIG. 6, and FIG. 7 are diagrams illustrating positions of dummy channels of data driving circuit chips in the display device according to the exemplary embodiment of the present invention by the table illustrated in FIG. 3, respectively.

FIG. 4 illustrates an example in which a position of dummy channel Ch_d is the center of a data driving circuit chip DICk (k=1, 2, . . . , n). At least one output channel Ch_o may be positioned at both sides of the dummy channel Ch_d. The number of output channels Ch_o is which are positioned at both sides of the dummy channel Ch_d may be substantially the same as each other.

Data lines De and Df connected with the output channel Ch_o of the data driving circuit chip DICk are positioned in a display area DAk corresponding to the data driving circuit chip DICk of display areas of the display panel 300. The center of the data driving circuit chip DICk and the center of the corresponding display area DAk may substantially coincide with each other, as illustrated with the dotted line. According to an exemplary embodiment illustrated in FIG. 4, the center of an area of the dummy channels Ch_d positioned at the center of the data driving circuit chip DICk may be substantially aligned with the center of the corresponding display area DAk. Here, the center of the dummy channels Ch_d means the center of a region where the at least one dummy channel Ch_d is positioned.

Accordingly, straight distances of fan-out parts Fout of two data lines which are positioned at ends of both sides of the data driving circuit chip DICk may be substantially the same as each other. Here, the fan-out parts Fout may entirely form a fan shape as a portion of the data lines De and Df which are positioned between the display area DAk and the data driving circuit chip DICk.

Figure 5:
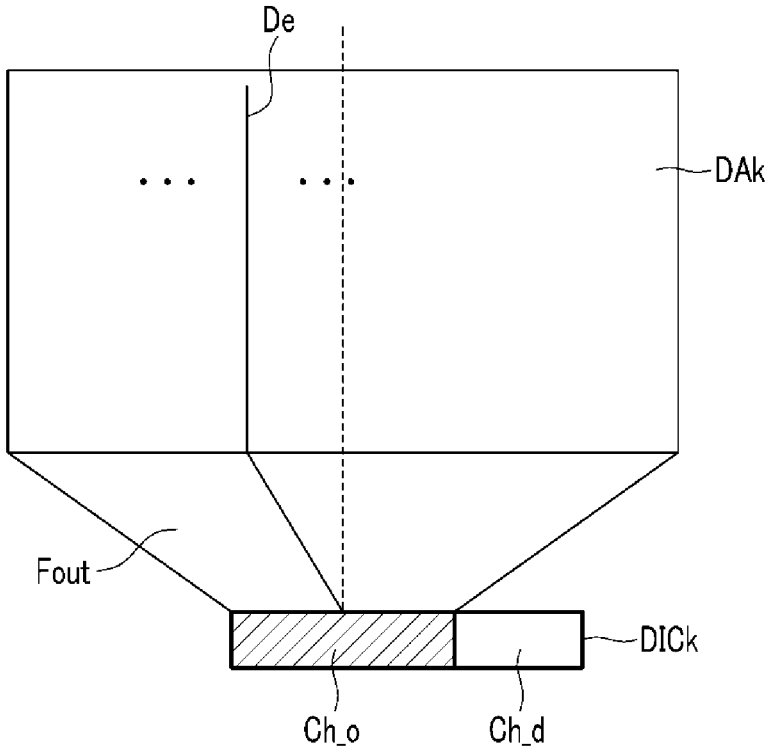

FIG. 5 illustrates an example in which the dummy channel Ch_d is positioned at a first side (for example, a right side) of the data driving circuit chip DICk (k=1, 2, . . . , n). At least one output channel Ch_o of the data driving circuit chip DICk is positioned at a second side (for example, a left side), which is opposite to the first side of the driving circuit chip DICk.

A data line De connected with the output channel Ch_o of the data driving circuit chip DICk is positioned in the display area DAk corresponding to the data driving circuit chip DICk. The center of the data driving circuit chip DICk and the center of the corresponding display area DAk may not substantially coincide with each other. According to the exemplary embodiment illustrated in FIG. 5, the center of the output channel Ch_o of the data driving circuit chip DICk may substantially coincide with the center of the corresponding display area DAk, as illustrated with the dotted line. Here, the center of the output channel Ch_o means the center of the region where the output channel Ch_o is positioned. Accordingly, the straight distances of fan-out parts Fout of two data lines, which are positioned at both ends of at least one output channel Ch_o of the data driving circuit chip DICk, may be substantially the same as each other.

Figure 6:
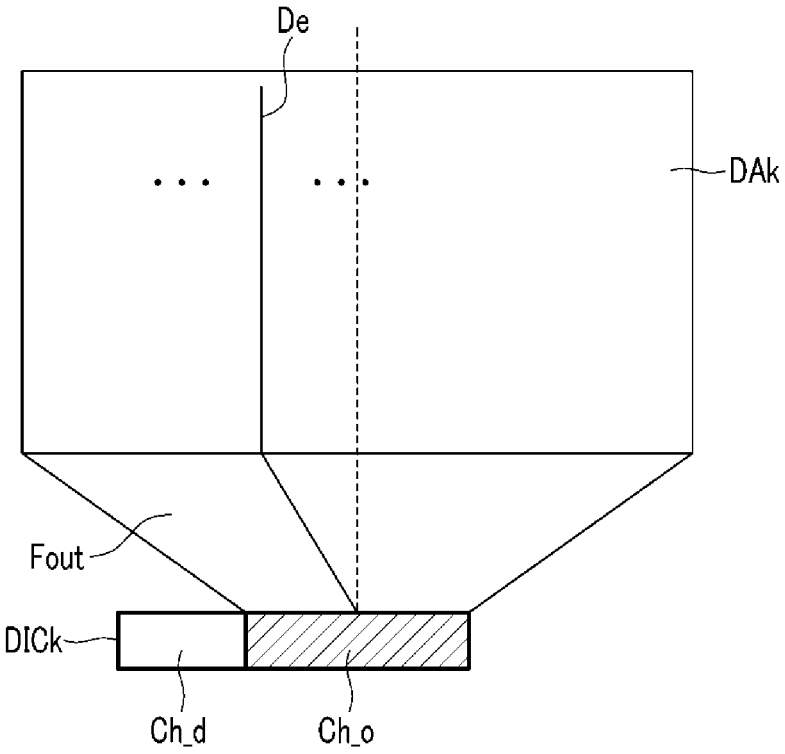

FIG. 6 illustrates an example in which dummy channel Ch_d is positioned at a second side (for example, a left side) of the data driving circuit chip DICk (k=1, 2, . . . , n). At least one output channel Ch_o of the data driving circuit chip DICk is positioned at the first side (for example, the right side) which is opposite to the second side of the data driving circuit chip DICk.

The data line De connected with the output channel Ch_o of the data driving circuit chip DICk is positioned in the display area DAk corresponding to the data driving circuit chip DICk. The center of the data driving circuit chip DICk and the center of the corresponding display area DAk may not substantially coincide with each other. According to the exemplary embodiment illustrated in FIG. 6, the center of the output channel Ch_o of the data driving circuit chip DICk may substantially coincide with the center of the corresponding display area DAk, as illustrated with the dotted line. Accordingly, the straight distances of fan-out parts Fout of two data lines which are positioned at both ends of at least one output channel Ch_o of the data driving circuit chip DICk may be substantially the same as each other.

Figure 7:
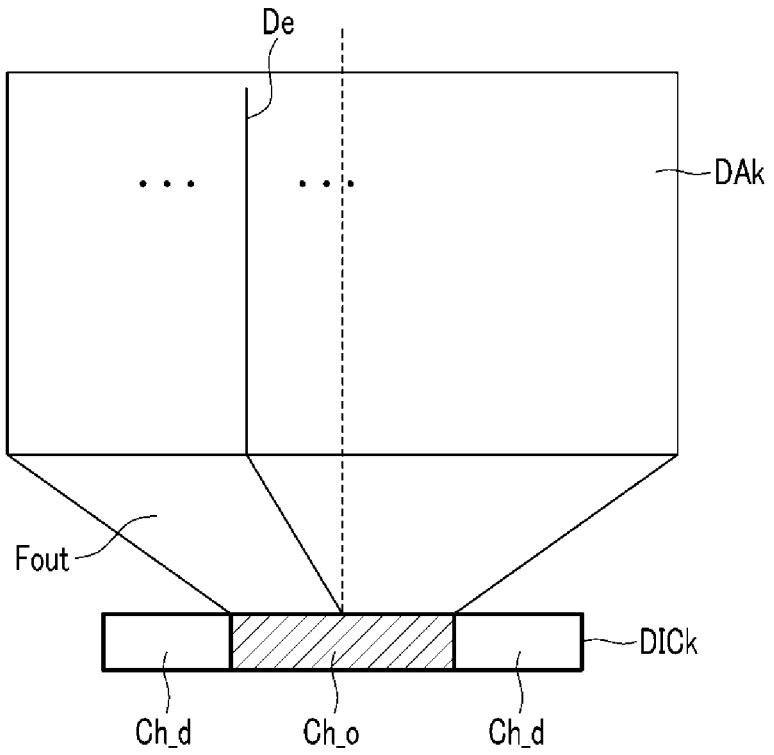

FIG. 7 illustrates an example in which dummy channels Ch_d are positioned at is the first side and the second side, which are both sides of the data driving circuit chip DICk (k=1, 2, . . . , n). At least one output channel Ch_o of the data driving circuit chip DICk is positioned between the dummy channels Ch_d.

The data line De connected with the output channel Ch_o of the data driving circuit chip DICk is positioned in the display area DAk corresponding to the data driving circuit chip DICk. The number of dummy channels Ch_d which are positioned at one of both sides with respect to the output channel Ch_o of the data driving circuit chip DICk may be the same as each other or may be different from each other. When the number of dummy channels Ch_d which are positioned at one of both sides is the same as each other, the center of the data driving circuit chip DICk and the center of the corresponding display area DAk may be substantially aligned with each other.

According to the exemplary embodiment illustrated in FIG. 7, the center of the output channel Ch_o of the data driving circuit chip DICk may substantially coincide with the center of the corresponding display area DAk, as illustrated with the dotted line. Accordingly, the straight distances of fan-out parts Fout of two data lines which are positioned at both ends of at least one output channel Ch_o of the data driving circuit chip DICk may be substantially the same as each other.

A method of setting positions and the number of dummy channels of the data driving circuit chips in the display device according to an exemplary embodiment of the present invention will be described with reference to FIG. 8, together with the exemplary embodiment described above.

Figure 8:
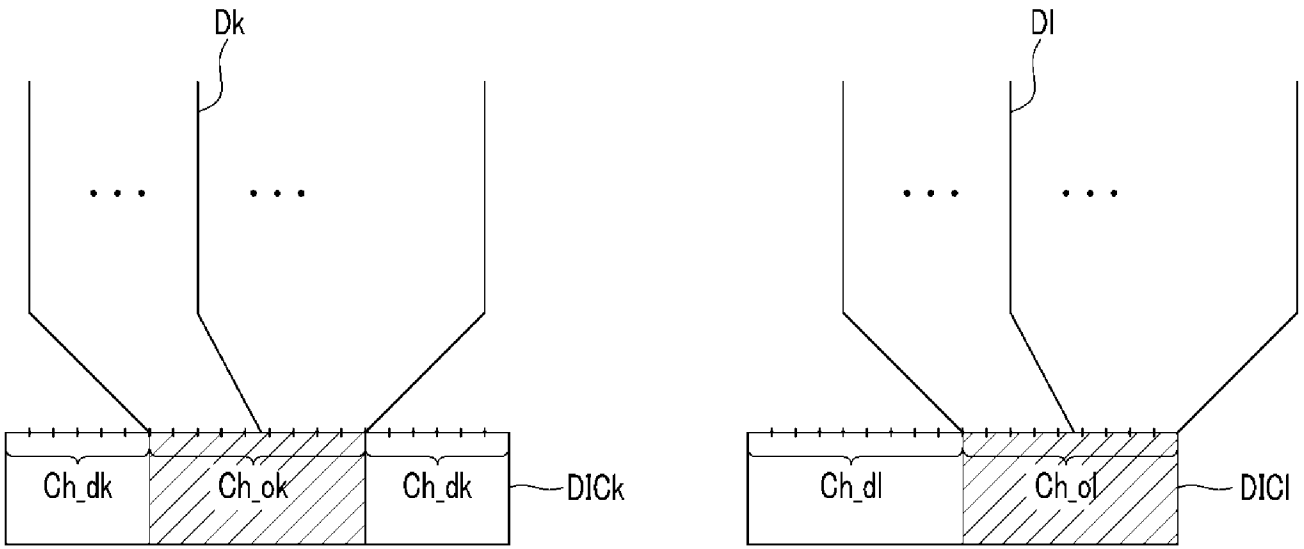
FIG. 8 is a diagram illustrating dummy channels of two data driving circuit chips included in the display device according to an exemplary embodiment of the present invention.

FIG. 8 is a diagram illustrating dummy channels of two data driving circuit chips DICk and DICl included in the display device according to an exemplary embodiment of the present invention.

In one display device, a position of dummy channels Ch_dk of one data driving circuit chip DICk and a position of a dummy channel Ch_dl of the other data driving circuit chip DICl may be the same as each other or may be different from each other, as illustrated in FIG. 8. The output channel Ch_ok of the data driving circuit chip DICk is connected with a plurality of data lines Dk to output a data signal, and the output channel Ch_ol of the data driving circuit chip DICl is connected with a plurality of data lines D1 of the display panel 300 to output a data signal.

The number of dummy channels Ch_dk of the data driving circuit chip DICk and the number of dummy channels Ch_dl of the data driving circuit chip DICl may be set according to dummy data stored in the memory 650 or a dummy control signal DUMM, respectively.

The dummy data stored in the memory 650 or the dummy control signals DUMM1-DUMMn transmitted to the respective data driving circuit chips DIC1-DICn include information on the number of dummy channels in the respective data driving circuit chips DIC1-DICn. The information regarding the number of dummy channels may have various bits by considering the maximum number of channels of the data driving circuit chips DIC1-DICn, and may be set to N multiples (N is a natural number) in order to efficiently use the bits and the memory 650. The number of dummy channels may be set for each of data driving circuit chips DIC1-DICn.

For example, in the case where the information on the number of dummy channels is set as a multiple of two and 10 bits, the number of dummy channels of the respective data driving circuit chips DIC1-DICn may be set up to 2*2^10=2,048, and in this case, the maximum number of channels of the data driving circuit chips DIC1-DICn may be 2,048. When a value of the N multiples used in the information on the number of dummy channels is large, the bits of the information regarding the number of dummy channels may be decreased and the memory 650 storing the dummy data may be efficiently used.

When the position of the dummy channels of the data driving circuit chips DIC1-DICn of the data driver 500 and the number of dummy channels may be freely set according to a dummy control signal DUMM from the signal controller 600, the degree of freedom in a layout of the data driving circuit chips DIC1-DICn is increased, thereby increasing flexibility in the design of the display panel 300 such that a size of a peripheral area of the display panel may be minimized.

Effects according to various exemplary embodiments of the present invention will be described with reference to FIGS. 9 and 10.

Figure 9:
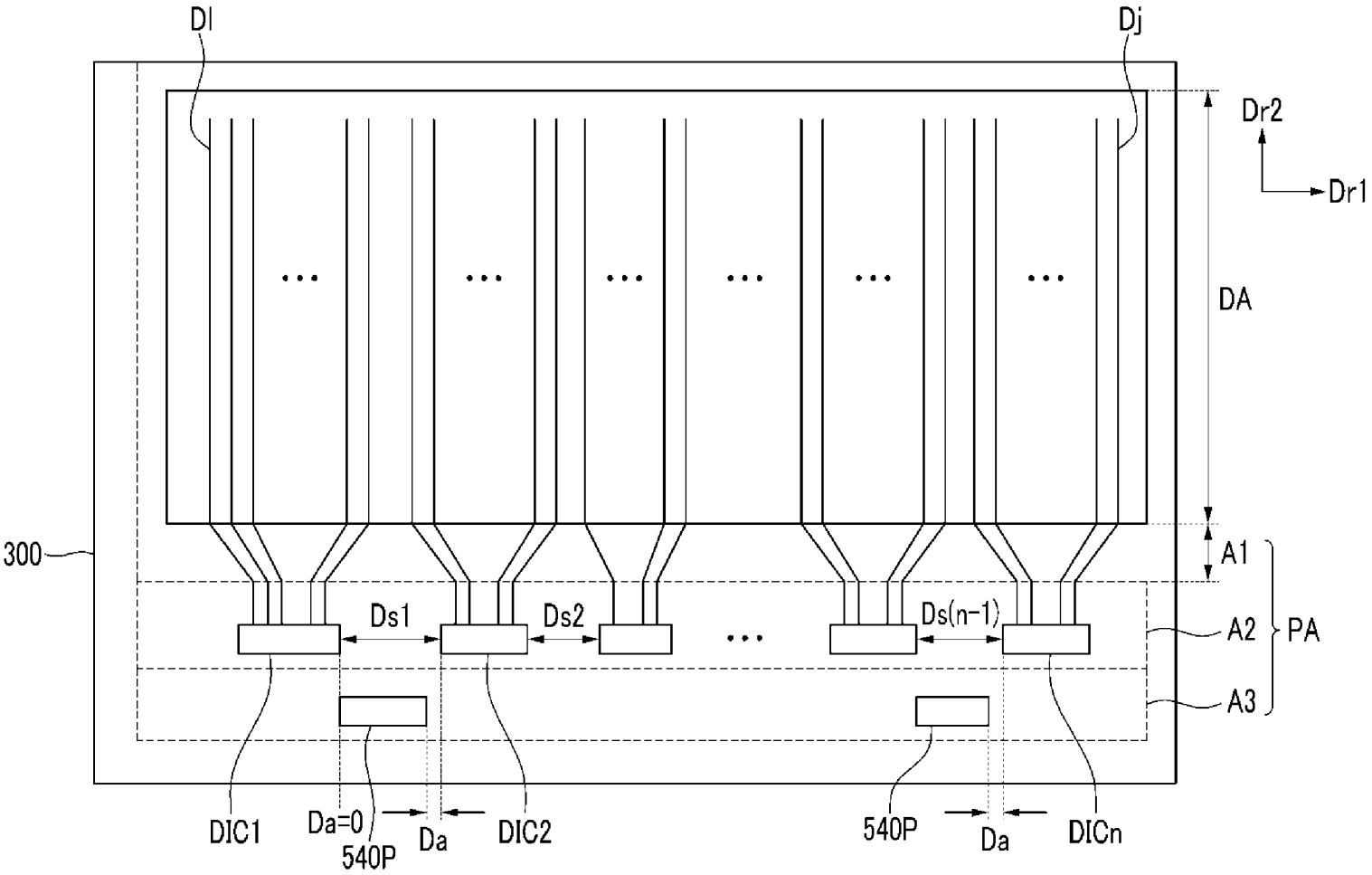
FIG. 9 and FIG. 10 are block diagrams of a display device according to exemplary embodiments of the present invention.

FIG. 9 is a block diagram of the display device according to an exemplary embodiment of the present invention.

Referring to FIG. 9, the display device according to an exemplary embodiment of the present invention includes a display panel 300 and at least one of data driving circuit chips DIC1-DICn.

The display panel 300 includes a display area DA displaying an image and a peripheral area PA. The peripheral area PA may include a first region A1, a second region A2, and a third region A3 which are adjacent to each other.

A plurality of data lines D1-Dj is positioned in the display area DA. The plurality of data lines D1-Dj extend to the first region A1 of the peripheral area PA, where they are arranged in a fan shape to form a fan-out part and may then form a pad part for connection with the data driver in the second region A2, which is positioned outside the first region A1.

The data driving circuit chips DIC1-DICn may be connected with the pad parts of the data lines D1-Dj in the second region A2. The number of data lines D1-Dj connected with the respective data driving circuit chips DIC1-DICn may be determined according to the number of dummy channels set for the respective data driving circuit chips DIC1-DICn and the number of all the channels.

Distances Ds1, Ds2, . . . , Ds(n−1) between the adjacent data driving circuit chips DIC1-DICn may be freely determined according to the number and position of dummy channels set for the respective data driving circuit chips DIC1-DICn. That is, the number or the position of dummy channels of the data driving circuit chips DIC1-DICn may be set according to an exemplary embodiment of the present invention so that a designer may freely determine a layout of the data driving circuit chips DIC1-DICn or a distance between the data driving circuit chips DIC1-DICn according to the design needs of the display panel 300.

As such, because the designer may freely change the positions of the data driving circuit chips DIC1-DICn, the kinds of data driving circuit chips DIC1-DICn which are available to be used may be increased.

Various control circuits of the signal controller 600 and the like may be installed on a printed circuit board (PCB) (not illustrated) to be connected with the display panel 300 through a flexible printed circuit film and the like. The flexible printed circuit film connected with the printed circuit board (PCB) may be connected with a connection pad 540P formed in the third region A3 of the display panel 300.

According to an exemplary embodiment of the present invention, the positions of the data driving circuit chips DIC1-DICn may be freely designed such that the data driving circuit chips DIC1-DICn may be designed so that the connection pad 540P and the data driving circuit chips DIC1-DICn are not overlapped with each other in the second direction Dr2 to which the data lines D1-Dj extend. That is, the data driving circuit chips DIC1-DICn may be designed so that a distance Da between the connection pad 540P and the first direction Dr1 of the data driving circuit chips DIC1-DICn may be reduced to zero.

As such, the connection pad 540P is positioned in a region corresponding to a space between the data driving circuit chips DIC1-DICn, and as a result, an area of the third region A3 is minimized since a wire connecting the data driving circuit chips DIC1-DICn and the connection pad 540P may be disposed between adjacent data driving circuit chips DIC1-DICn, and a space capable of forming the wire connecting the data driving circuit chips DIC1-DICn and the connection pad 540P may be sufficiently ensured. Accordingly, a size of the peripheral area PA of the display panel 300 may be decreased. Further, a size of the display panel 300 may be freely designed according to a design element of the display panel 300.

Figure 10:
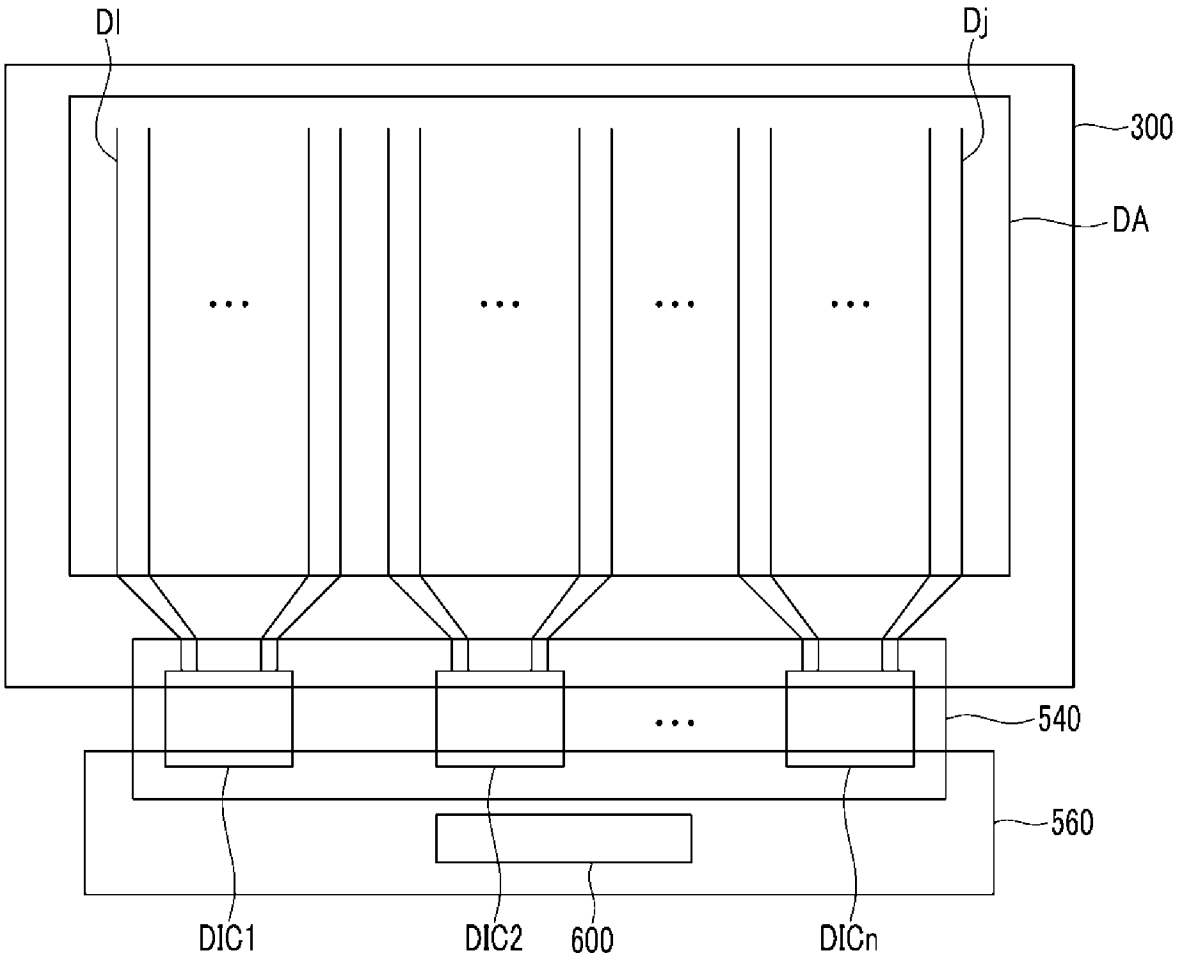

FIG. 10 is a block diagram of a display device according to an exemplary embodiment of the present invention.

A display device according to an exemplary embodiment illustrated in FIG. 10 is almost the same as the exemplary embodiment illustrated in FIG. 9.

However, in the exemplary embodiment illustrated in FIG. 10, the data driving circuit chips DIC1-DICn may be installed on a flexible printed circuit film (FPC film) 540. The flexible printed circuit film 540 may include a plurality of data transmitting lines (not illustrated) connected with the data driving circuit chips DIC1-DICn, and the data transmitting lines may be connected with the pad parts of the data lines D1-Dj formed on the display panel 300 to transmit data signals form the data driving circuit chips DIC1-DICn to the data lines D1-Dj.

The flexible printed circuit film 540 may be connected with a printed circuit board (PCB) 560 on which the signal controller 600 is installed to transmit various control signals and driving signals from the signal controller 600 to the data driving circuit chips DIC1-DICn and the like.

Even in the exemplary embodiment illustrated in FIG. 10, when the positions of the data driving circuit chips DIC1-DICn may be freely designed, the positions and the number of dummy channels may be freely allocated, and as a result, the positions and a layout of the data driving circuit chips DIC1-DICn positioned on the flexible printed circuit film 540 may also be freely designed. Accordingly, the size of the display panel 300 may be freely designed according to a design element of the display panel 300. Further, the kinds of data driving circuit chips DIC1-DICn which are available to be used may be increased.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel comprising a plurality of data lines;

a data driver comprising at least one data driving circuit chip configured to transmit data signals to the plurality of data lines; and a signal controller configured to transmit a dummy control signal and an output image signal to the at least one data driving circuit chip, wherein:

the dummy control signal comprises information regarding a number of dummy channels that are not connected with the data lines and are included in the data driving circuit chip, and information on a position of the dummy channels when the data driving circuit chip comprises one or more dummy channels; and a center of a display area where the data lines connected with the data driving circuit chip are positioned is substantially aligned with a center of an area of one of the dummy channels or a center of an area of output channels of the data driving circuit chip connected with the data lines according to the position of the dummy channels.

2. The display device of claim 1, further comprising:

a memory configured to store dummy data for generating the dummy control signal in the signal controller.

3. The display device of claim 2, wherein the information regarding the position of the dummy channels designates the position of the dummy channels as any one of a center of the data driving circuit chip, a first side of the data driving circuit chip, a second side opposite the first side of the data driving circuit chip, and both sides of the data driving circuit chip.

4. The display device of claim 3, wherein when one of the dummy channels is disposed at the center of the data driving circuit chip, a center of a display area where the data lines connected with the data driving circuit chip are positioned and a center of an area of the one dummy channel are substantially aligned with each other.

5. The display device of claim 3, wherein when one of the dummy channels is disposed at the first side or the second side of the data driving circuit chip, a center of a display area where the data lines connected with the data driving circuit chip are positioned and a center of an area of output channels of the data driving circuit chip connected with the data lines are substantially aligned with each other.

6. The display device of claim 3, wherein when the dummy channels are positioned at both sides of the data driving circuit chip, a center of a display area where the data lines connected with the data driving circuit chip are positioned and a center of an area of output channels of the data driving circuit chip connected with the data lines are substantially aligned with each other.

7. The display device of claim 3, wherein the information on the number of the dummy channels is represented by M bits and N multiples, where each of M and N is a natural number.

8. The display device of claim 7, wherein the data driving circuit chip comprises N×2ˆM or fewer of the dummy channels.

9. The display device of claim 8, wherein the data driver comprises a plurality of the data driving circuit chips and at least one of the position and the number of the dummy channels is different from each other for at least two of the plurality of data driving circuit chips.

10. The display device of claim 1, wherein the information regarding the position of the dummy channels designates the position of the dummy channels as any one of a center of the data driving circuit chip, a first side of the data driving circuit chip, a second side opposite the first side of the data driving circuit chip, and both sides of the data driving circuit chip.

11. The display device of claim 10, wherein the dummy channel is disposed at the center of the data driving circuit chip, and a center of a display area where the data lines connected with the data driving circuit chip are positioned and a center of an area of the dummy channels are substantially aligned with each other.

12. The display device of claim 10, wherein the dummy channel is positioned at the first side or the second side of the data driving circuit chip, and a center of a display area where the data lines connected with the data driving circuit chip are positioned and a center of an area of output channels of the data driving circuit chip connected with the data lines are substantially aligned with each other.

13. The display device of claim 10, wherein the dummy channels are positioned at both sides of the data driving circuit chip, and a center of a display area where the data lines connected with the data driving circuit chip are positioned and a center of an area of output channels of the data diving circuit chip connected with the data lines are substantially aligned with each other.

14. The display device of claim 10, wherein the information regarding the number of the dummy channels is represented by M bits and N multiples, where each of M and N is a natural number.

15. The display device of claim 14, wherein the data driving circuit chip comprises N×2ˆM or fewer of the dummy channels.

16. The display device of claim 15, further comprising a plurality of the data driving circuit chips, wherein at least one of the position and the number of the dummy channels is different from each other for at least two of the plurality of data driving circuit chips.

17. The display device of claim 1, wherein the information on the number of the dummy channels is represented by M bits and N multiples, where each of M and N is a natural number.

18. The display device of claim 17, wherein the data driving circuit chip comprises N×2ˆM or fewer dummy channels.

19. The display device of claim 18, further comprising a plurality of the data driving circuit chips, wherein at least one of the position and the number of the dummy channels is different from each other for at least two of the plurality of data driving circuit chips.

20. The display device of claim 1, further comprising a plurality of the data driving circuit chips, wherein at least one of the position and the number of the dummy channels is different from each other for at least two of the plurality of data driving circuit chips.

21. The display device of claim 1, further comprising:

a flexible printed circuit film; and a printed circuit board on which the signal controller is disposed, wherein the data driving circuit chip is disposed on the flexible printed circuit film, and the printed circuit board is connected to the display panel through the flexible printed circuit film.

22. The display device of claim 8, further comprising:

a flexible printed circuit film; and a printed circuit board on which the signal controller is disposed, wherein the plurality of data driving circuit chips are disposed on the flexible printed circuit film, and the printed circuit board is connected to the display panel through the flexible printed.

* * * * *